US009254013B2

(12) United States Patent
Perez

(10) Patent No.: US 9,254,013 B2
(45) Date of Patent: Feb. 9, 2016

(54) HEADWEAR AND BLANKET SYSTEM AND METHOD

(71) Applicant: Hugo Washington Perez, Ramsey, NJ (US)

(72) Inventor: Hugo Washington Perez, Ramsey, NJ (US)

(73) Assignee: FRANCO MANUFACTURING CO., INC., Metuchen, NJ (US)

( * ) Notice: Subject to any disclaimer, the term of this patent is extended or adjusted under 35 U.S.C. 154(b) by 0 days.

(21) Appl. No.: 14/151,555

(22) Filed: Jan. 9, 2014

(65) Prior Publication Data

US 2014/0215689 A1 Aug. 7, 2014

Related U.S. Application Data

(60) Provisional application No. 61/750,588, filed on Jan. 9, 2013.

(51) Int. Cl.
*A42B 1/04* (2006.01)
*A42B 1/24* (2006.01)
*A42B 1/00* (2006.01)

(52) U.S. Cl.
CPC .. *A42B 1/006* (2013.01); *A42B 1/24* (2013.01)

(58) Field of Classification Search
CPC ..... A41D 3/08; A41D 2200/20; A41D 23/00; A41D 2023/004; A42B 1/006; A42B 1/24; A42B 1/048; A42B 1/04; A42B 1/067; A47G 9/0223; A47G 9/064; A47G 9/08; A47G 9/066; A47G 9/083
USPC ..... 2/84, 69.5, 88, 203, 202, 209.11, 2/209.13, 172, 94, 108, 85, 207; 5/485, 5/482, 486, 494
See application file for complete search history.

(56) References Cited

U.S. PATENT DOCUMENTS 265,536 A * 10/1882 Oberst ..... 2/84
364,762 A * 6/1887 King ..... 2/84
1,316,778 A * 9/1919 Ensten ..... A42B 1/045 2/172
1,399,523 A * 12/1921 Sable ..... A41D 23/00 2/203
1,505,183 A * 8/1924 Zucker ..... A42B 1/067 2/172
2,051,437 A * 8/1936 Dorn ..... 2/84
2,170,339 A * 8/1939 Reeves ..... A41D 3/00 2/84
2,372,110 A * 3/1945 Noone ..... 2/84
4,227,264 A * 10/1980 Spector et al. ..... 2/84
4,320,538 A * 3/1982 Saft ..... A41D 3/00 2/102
4,752,971 A * 6/1988 Meserol ..... 2/88
4,754,512 A * 7/1988 Chao-Yang ..... 5/482
4,928,321 A * 5/1990 Dobson ..... 2/84
5,211,668 A * 5/1993 Secord ..... A42B 1/046 2/172
5,421,045 A * 6/1995 Bowen ..... 5/485
6,223,367 B1 * 5/2001 French ..... A45C 3/10 383/4
6,370,692 B1 * 4/2002 Duyn et al. ..... 2/86
6,421,852 B1 * 7/2002 Shao ..... 5/413 R
7,178,185 B1 * 2/2007 Nattler ..... 5/482
8,505,117 B2 * 8/2013 Park ..... A41D 23/00 2/202
8,864,544 B2 * 10/2014 Anderman et al. ..... 446/27
2004/0199998 A1 * 10/2004 Shinner ..... 5/482
2005/0217004 A1 * 10/2005 Haberfeld ..... 2/69.5
2013/0239290 A1 * 9/2013 Rossi ..... 2/84

* cited by examiner

*Primary Examiner* — Amy Vanatta
(74) *Attorney, Agent, or Firm* — Maldjian Law Group LLC

(57) ABSTRACT

Headwear and blanket system and method, comprising a blanket having a first end comprising a lip having a snap or other securing means for removably securing the headwear to the blanket; wherein the headwear includes a snap or other means for removably securing itself to the blanket, preferably at the lip area of the first end of the blanket. The headwear may be detachably attached to the blanket using other means like hook and loop fasteners or button and button hole. The blanket and the headwear may comprise coordinating: themes, e.g., sports, colleges, schools, characters, animals as well as colors, style, and the like. The headwear may be secured in such a fashion as to surround the lip of the blanket of the first end of the blanket. The blanket may be partially or completely rolled up and stored inside the headwear for transportation and retail display purposes.

10 Claims, 4 Drawing Sheets

HEADWEAR AND BLANKET SYSTEM AND METHOD

CROSS-REFERENCE TO RELATED APPLICATION

This application claims priority to U.S. Provisional Patent Application No. 61/750,588, filed Jan. 9, 2013, the entirety of which application is incorporated by reference into this application.

BACKGROUND

1. Field of the Invention

Embodiments of the present invention generally relate to garments and textiles and in particular to an integral headwear and blanket system and method.

2. Description of Related Art

Adults and children of all ages wear headwear for warmth and to make a fashion statement. Some headwear is worn outside but there are occasions where people, especially children and teenagers, who will wear the items indoors. For example, teenagers will keep their headwear on, like plush toy hats, during ski trips or sleigh riding, even after they come off the slopes. They wear the headwear indoors while hanging out, just before bedtime, at bedtime, and when they wake up.

Adults and children of all ages like to have throws or blankets to keep them warm, and for security or comfort while "hanging around" indoors, outdoors by a fireplace, or even walking around, e.g., with their friends, to and from school, at the mall, and the like. People often times like to wear the throws or blankets along with their headwear like plush hats. Plush hats and other headwear is collectively referred to herein as "headwear" and throws, blankets, towels, comforters, and like is collectively referred to herein as "blankets."

Many people like to coordinate their outerwear. Most people settle for a close match but there is no coordinated effort known to match headwear with blankets. There is also no known combination of a headwear and blanket that may be detachably attached to each other so the user can wear both the headwear and blanket at the same time and be able to keep the two items together while wearing them or when the items are not being used.

Thus, there is a need for coordinating or integrating outerwear like headwear with textiles like blankets. There is also a need for outerwear like headwear to be detachably secured in some manner with coordinating blankets in order to wear the two items together and to be able to transport the two items without losing either piece in transit or while the pieces are not being used.

SUMMARY

An embodiment of the present invention comprises a headwear and blanket system, a blanket having a first end comprising a lip having a snap or other means for removably securing the headwear to the blanket; and headwear, wherein the headwear includes a snap or other means for removably securing itself to the blanket, preferably at the lip area of the first end of the blanket.

The headwear may be detachably attached to the blanket using the snap or other means like hook and loop fasteners. The blanket and the headwear may comprise coordinating themes, colors, styles, and the like.

The headwear may comprise characters, or animal themes, or a combination of both.

The headwear may be secured in such a fashion as to surround the lip of the blanket of the first end of the blanket.

The blanket may be partially or completely rolled up and stored inside the headwear for transportation and/or retail display purposes.

Another embodiment comprises a method of storing a blanket, comprising: providing a blanket, providing headwear detachably attached to the blanket; rolling up the blanket; inserting the rolled up blanket into the opening of the headwear; and storing the blanket and headwear together in a coordinated manner. The coordinated manner may be for retail display purposes.

The preceding is a simplified summary of the present invention to provide an understanding of some aspects of the present invention. This summary is neither an extensive nor exhaustive overview of the present invention and its various embodiments. It is intended neither to identify key or critical elements of the present invention nor to delineate the scope of the present invention but to present selected concepts of the present invention in a simplified form as an introduction to the more detailed description presented below. As will be appreciated, other embodiments of the present invention are possible utilizing, alone or in combination, one or more of the features set forth above or described in detail below.

BRIEF DESCRIPTION OF THE DRAWINGS

So the manner in which the above recited features of the present invention may be understood in detail, a more particular description of embodiments of the present invention, briefly summarized above, may be had by reference to embodiments, several of which are illustrated in the appended drawings.

Figures in the appended drawings, like the detailed description, are examples. As such, the Figures and the detailed description are not to be considered limiting, and other equally effective examples are possible and likely. Furthermore, like reference numerals in the Figures indicate like elements, and wherein.

Figures 1A, 1B:
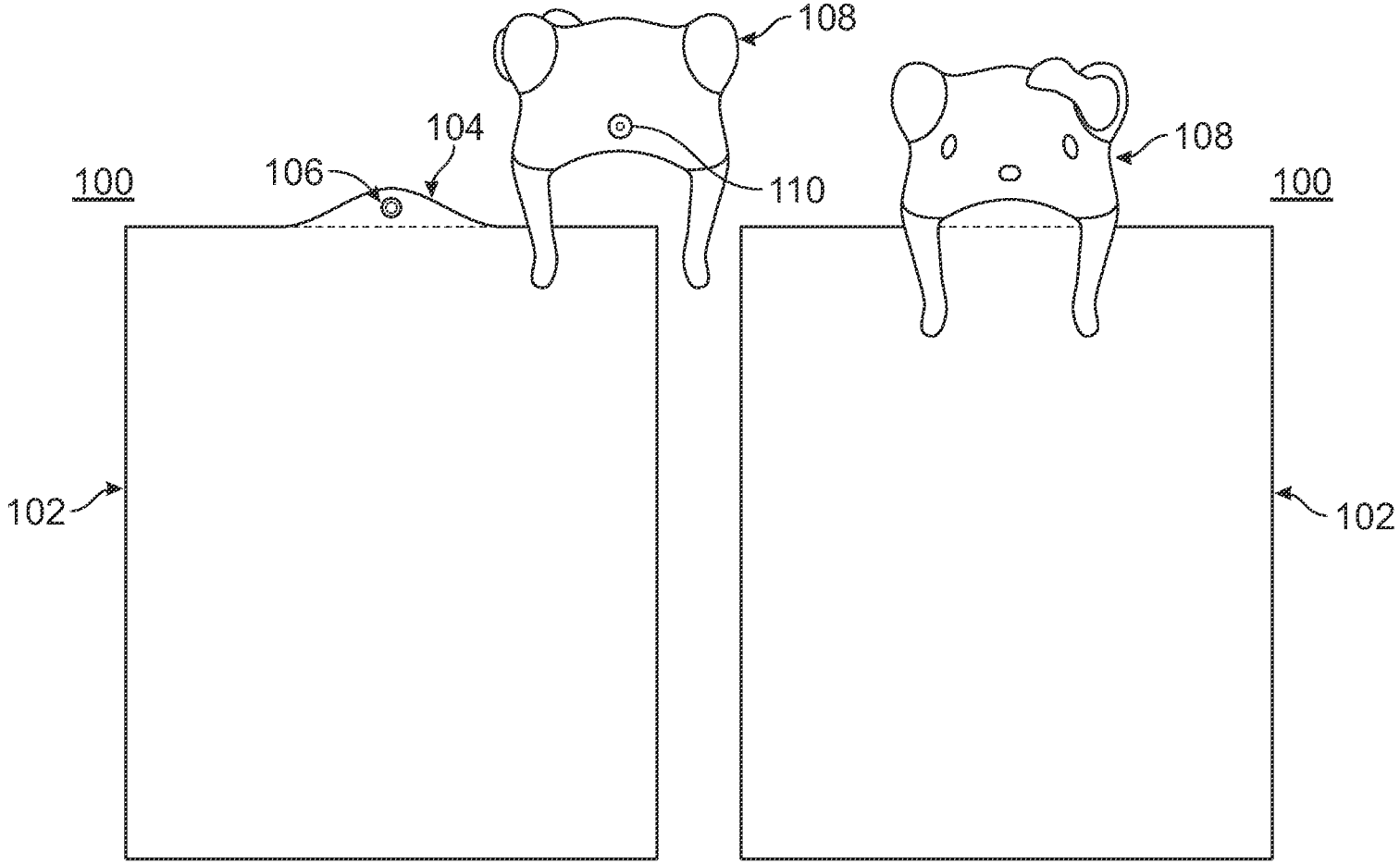
FIG. 1A depicts an example headwear in a detached position from a blanket in accordance with an embodiment of the present invention.
FIG. 1B depicts the headwear of FIG. 1A in an attached position to the blanket of FIG. 1A in accordance with an embodiment of the present invention.

The headings used herein are for organizational purposes only and are not meant to be used to limit the scope of the description or the claims. As used throughout this application, the word "may" is used in a permissive sense (i.e., meaning having the potential to), rather than the mandatory sense (i.e., meaning must). Similarly, the words "include", "including", and "includes" mean including but not limited to. To facilitate understanding, like reference numerals have been used, where possible, to designate like elements common to the figures. Optional portions of the figures may be illustrated using dashed or dotted lines, unless the context of usage indicates otherwise.

DETAILED DESCRIPTION

In the following detailed description, numerous specific details are set forth in order to provide a thorough understanding of embodiments or other examples described herein. In some instances, well-known methods, systems, procedures and components have not been described in detail, so as to not obscure the following description.

Further, the examples disclosed are for exemplary purposes only and other examples may be employed in lieu of, or in combination with, the examples disclosed. It should also be noted the examples presented herein should not be construed as limiting of the scope of embodiments of the present disclosure, as other equally effective examples are possible and likely.

The phrases "at least one", "one or more", and "and/or" are open-ended expressions that are both conjunctive and disjunctive in operation. For example, each of the expressions "at least one of A, B and C", "at least one of A, B, or C", "one or more of A, B, and C", "one or more of A, B, or C" and "A, B, and/or C" means A alone, B alone, C alone, A and B together, A and C together, B and C together, or A, B and C together.

The term "a" or "an" entity refers to one or more of that entity. As such, the terms "a" (or "an"), "one or more" and "at least one" can be used interchangeably herein. It is also to be noted that the terms "comprising", "including", and "having" can be used interchangeably.

FIG. 1A depicts a system 100 comprising headwear 108 in a detached position from a blanket 102 in accordance with an embodiment of the present invention. The blanket 102 comprises at least for ends. A first end includes a lip 104. The lip 104 depicted in FIG. 1A is located substantially in the center of the first end of the blanket 102 but can be located anywhere on the end or on any other edge of the blanket 102. The lip 104 also includes a securing means 106 for securing the headwear 108 to the blanket 102. In this example, the means 106 is a snap. However, one of ordinary skill in the art would appreciate that this means 106 could be anything from hook and loop fasteners to button hole/button combinations, or any combinations of the above means thereof.

The headwear 108 shown in FIG. 1 is merely an example of the type of article of clothing contemplated by this invention. As depicted, the receiving portion 110 of the means for securing the headwear to the blanket is located at the bottom, outer end and center of the headwear 108. Other options for locations of the headwear means for securing 110 are contemplated by this present invention. For example, the snap 110 can be located anywhere on the headwear 108 provided the headwear 108 is capable of being detachably attachable or secured to the blanket 102 during storage or during use.

Also shown in FIG. 1 are the aspects of the blanket 102 and headwear 108 being coordinated in color, style, theme, character, etc. The headwear 108 may depict a favorite character, animal or combination thereof, where, when worn, the user can play that character or role. The headwear and blanket can be made of any material appropriate to be worn by a user and by way of example, the headwear can be made of soft fabric material or any other material suitable for comfort, warmth, and the like. The theme of the system 100 includes the headwear 108, which may be tied into the theme of the blanket 102. Although the blanket 102 of the system 100 shown in FIG. 1 is blank, it is to be contemplated that the blanket 102 may include drawings, stitching, or any other indicia of characters, themes, animals, etc. that may coordinate or not coordinate with the theme of the headwear 108. The themes are unlimited but include sports themes, sports' team themes, colleges and university themes, high school and grammar school themes, movie or popular TV character themes, and the like.

FIG. 1B depicts the system 100 described above with respect to FIG. 1A with the headwear 108 secured to the blanket 102 by connecting means 106 to means 110 of the headwear 108 at the lip 104, in a secured position. That is, in FIG. 1B, the headwear 108 is detachably secured to the lip 104 of the first end of the blanket 102 using the snaps 106 and 110 on both the blanket 102 and the headwear 108, respectively.

In operation, a user would be able to have the blanket 102 for comfort, warmth or fashion, worn on the user's shoulders and/or wrapped around the body, while knowing that the headwear 108 is securely attached to the blanket 102. That way, during the use, the user, can put the headwear 108 on his/her head or take it off and secure it, all the while having the security of the blanket 102 nearby.

In one example, the user may wear the headwear 108 during the day and just before retiring for the night. Then, when the user wishes to go to sleep, the user takes the headwear 108 off, snaps it to the lip 104 of the first end of the blanket and goes to sleep. Then, when the user wakes up in the morning, the headwear 108 is right there. The user does not have to concern himself/herself with losing the headwear 108 and having to search for it first thing in the morning.

In another example, the user snaps the headwear 108 onto the blanket 102, puts the headwear 108 on his/her head, wraps the blanket 102 around him/her and drifts off to sleep with the comfort, warmth and security of the headwear 108 and blanket 102 as a fully operational headwear and blanket system 100.

Figure 2B:
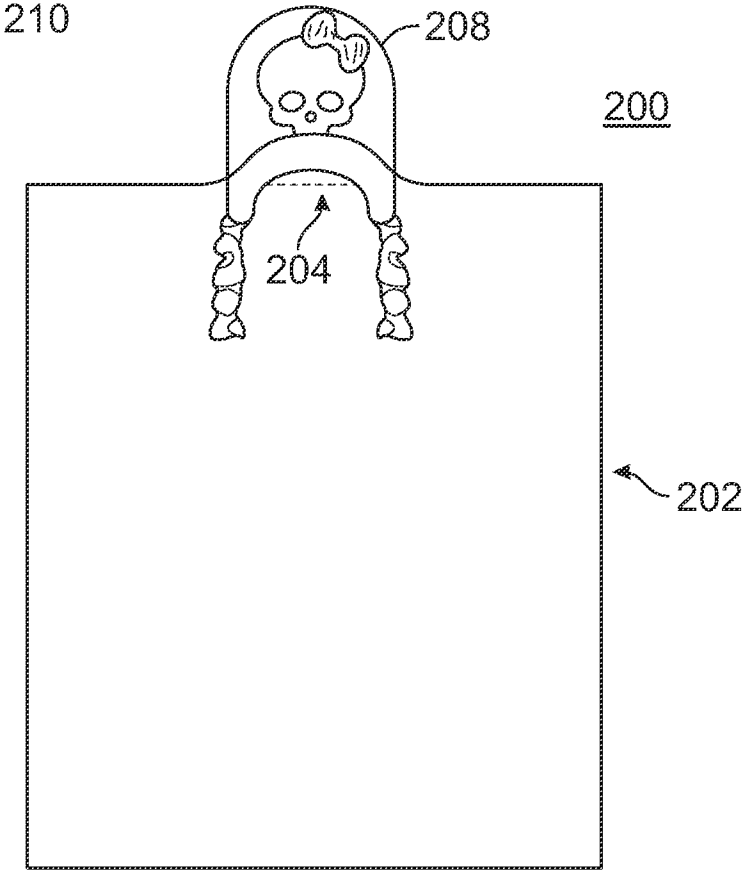
FIG. 2B depicts the headwear of FIG. 2A in an attached position to the blanket of FIG. 2A in accordance with an embodiment of the present invention.
Figure 2A:
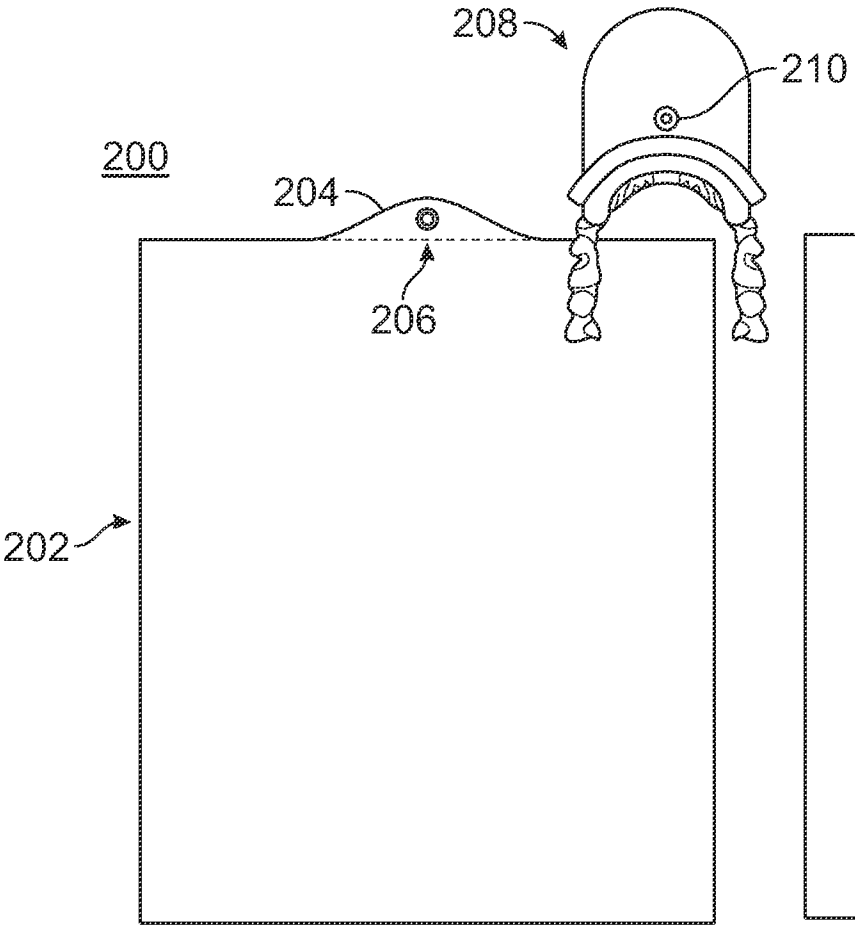
FIG. 2A depicts another example headwear in a detached position from a blanket in accordance with an embodiment of the present invention.

FIGS. 2A and 2B depict another embodiment of the present invention, depicting a system 200, including headwear 208 in a detached position from a blanket 202. FIG. 2B depicts the headwear 208 in an attached position to the blanket 202. In this embodiment, the headwear can be a ski hat of sorts whereas the embodiment of FIGS. 1A and 1B, the headwear is a plush character hat. Both and all other combinations and variations are contemplated by the present invention and the headwear should not be limited to these two embodiments.

Figure 3A:
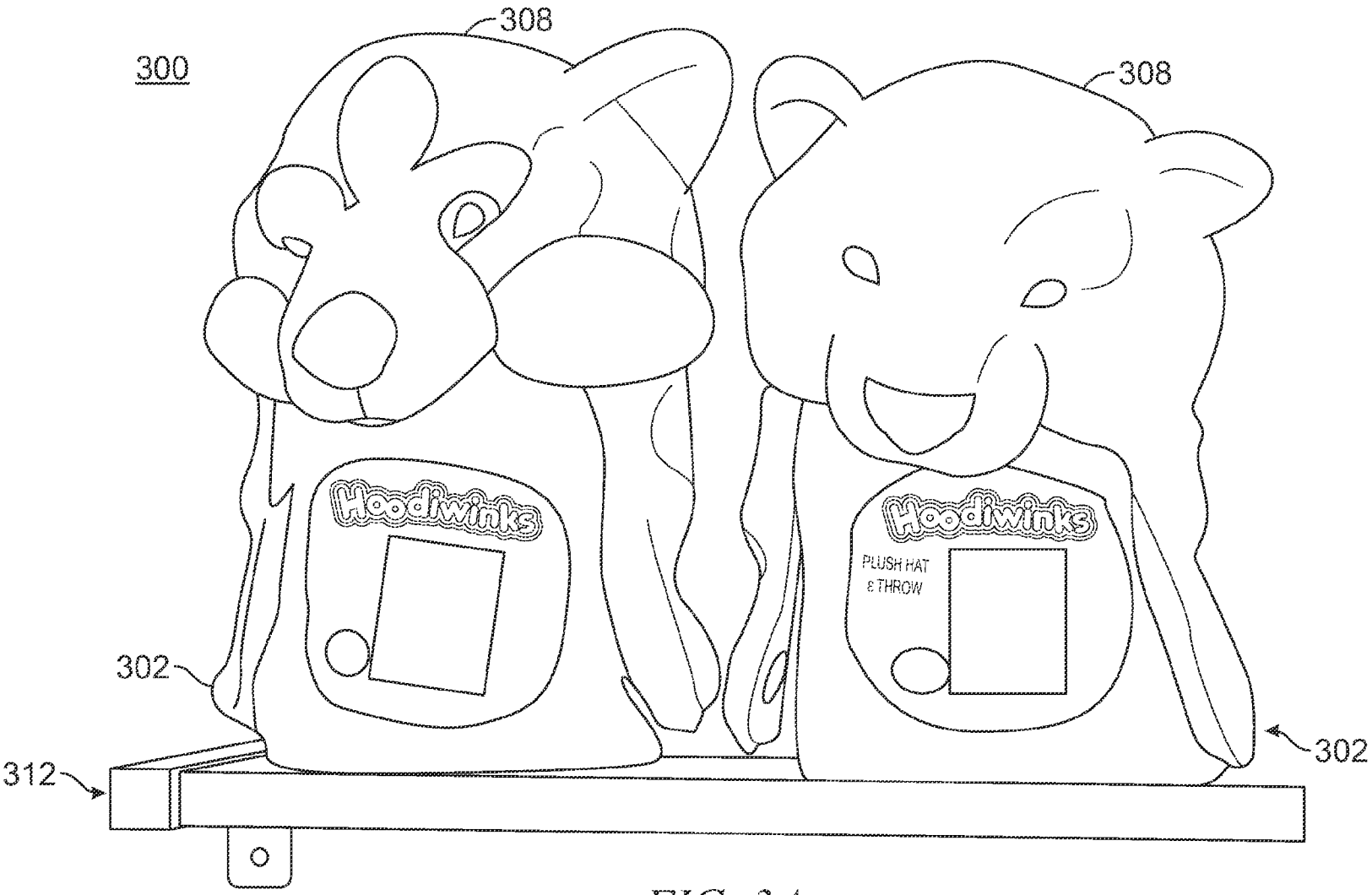
FIG. 3A depicts at least two blankets after they has been rolled up and inserted into an opening in their respective, coordinated headwear in accordance with an embodiment of the present invention and shown on a display shelf.

FIG. 3A depicts a system 300 including the blanket 302 rolled up and inserted either partially or completely within the headwear 308 in accordance with the present invention. It is contemplated by the present invention that the blanket 302 stored this way within the headwear 308, is effective for aesthetic appeal and effective retail display purposes to increase conversion of sales. That is, for example, when the blanket 302 is stored within the headwear 308, the product or system 300 is uniquely displayed on retail shelves 312. This embodiment of the system 300 is aesthetically pleasing to the consumer and thus attractive to the consumer, whereby the consumer is more likely than not to purchase the headwear and blanket system 300 by viewing such a display on the retail shelves 312.

Figure 3B:
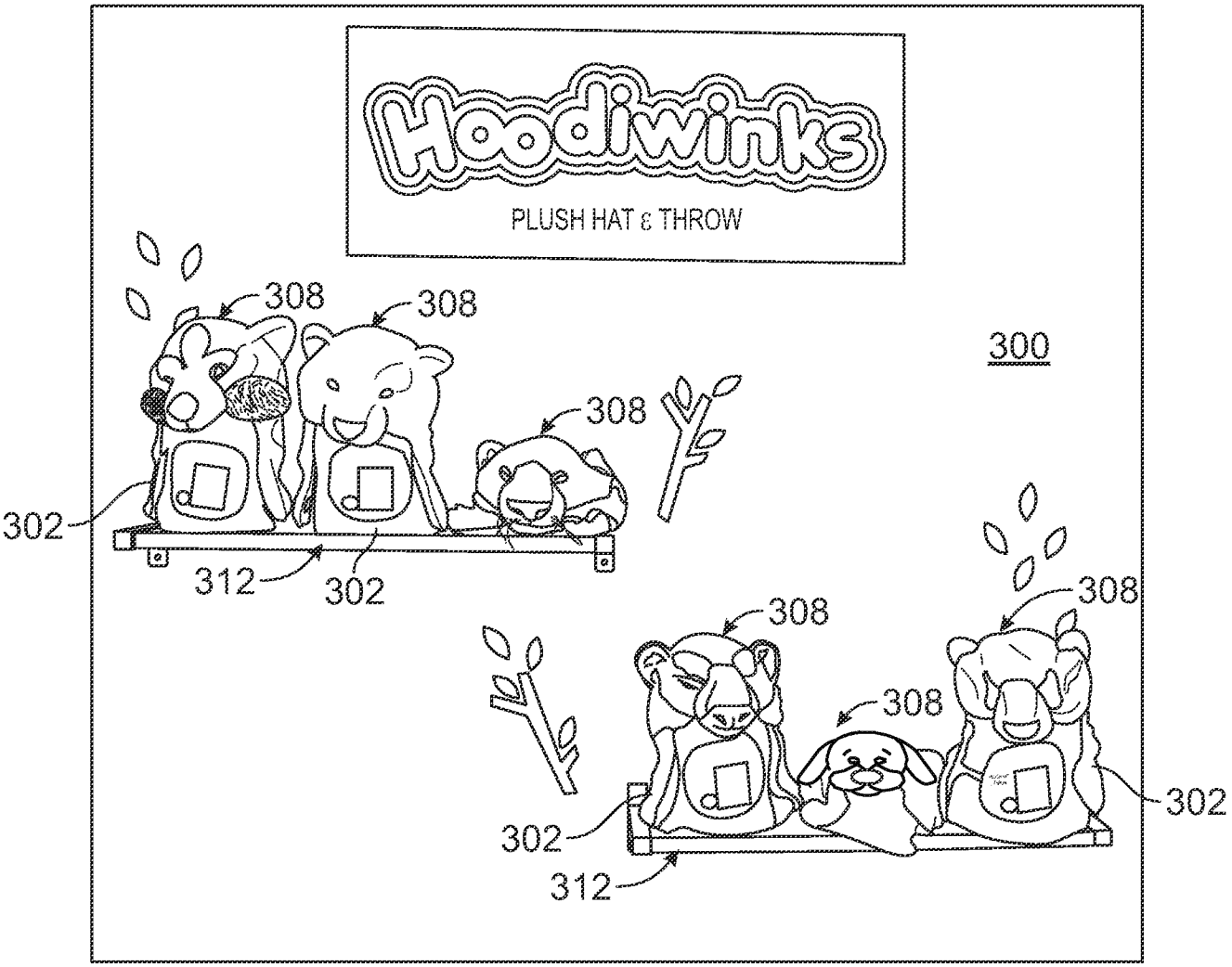
FIG. 3B depicts multiple blankets rolled up inside respective coordinated headwear and on retail shelve displays in accordance with an embodiment of the present invention.

FIG. 3B depicts another embodiment of the system 300 in another retail shelving display scenario in accordance with the present invention. Here, there are multiple systems 300 on at least two retail shelves 312. This particular embodiment discloses a forest or jungle theme, including wall painting of trees along with animal characters for the headwear and blanket system 300.

The present invention, in various embodiments, configurations, and aspects, includes components, methods, processes, systems and/or apparatus substantially as depicted and described herein, including various embodiments, subcombinations, and subsets thereof. Those of skill in the art will understand how to make and use the present invention after understanding the present disclosure. The present invention, in various embodiments, configurations, and aspects, includes providing devices, systems, methods, and processes in the absence of items not depicted and/or described herein or in various embodiments, configurations, or aspects hereof, including in the absence of such items as may have been used in previous devices or processes, e.g., for improving performance, achieving ease and\ or reducing cost of implementation.

The foregoing discussion of the present invention has been presented for purposes of illustration and description. The foregoing is not intended to limit the present invention to the form or forms disclosed herein. In the foregoing Detailed Description for example, various features of the present invention are grouped together in one or more embodiments, configurations, or aspects for the purpose of streamlining the disclosure. The features of the embodiments, configurations, or aspects of the present invention may be combined in alternate embodiments, configurations, or aspects other than those discussed above. This method of disclosure is not to be interpreted as reflecting an intention that the claimed invention requires more features than are expressly recited.

Moreover, though the description of the present invention has included a description of one or more embodiments, configurations, or aspects and certain variations and modifications, other variations, combinations, and modifications are within the scope of the present invention, e.g., as may be within the skill and knowledge of those in the art, after understanding the present disclosure. It is intended to obtain rights, which include alternative embodiments, configurations, or aspects to the extent permitted, including alternate, interchangeable and/or equivalent structures, functions, ranges or steps to those claimed, whether or not such alternate, interchangeable and/or equivalent structures, functions, ranges or steps are disclosed herein, and without intending to publicly dedicate any patentable subject matter.

What is claimed is:

1. A headwear and blanket system, comprising:

a headwear having a first securing means; and a blanket detachably securable to the headwear, the blanket having four edges, wherein a first edge of the four edges comprises a lip, said lip having a curved border protruding from the first edge and a base bordering the first edge, the length of the base of the lip being less than half the length of the first edge, including thereon a second securing means for removably securing the blanket to the headwear, wherein the headwear is secured in such a fashion as to surround the lip of the first edge of the blanket.

2. The system of claim 1, wherein the securing means of the headwear and blanket comprises a snap system.

3. The system of claim 1, wherein the securing means of the headwear and blanket comprises hook and loop fasteners.

4. The system of claim 1, wherein the securing means of the headwear and blanket comprises a button and hole system.

5. The system of claim 1, wherein the blanket and the headwear comprise coordinating themes, colors, styles and characters.

6. The system of claim 5, where the headwear comprises TV or movie characters, sports teams, college or other school themes, or animal themes, or a combination of one or more.

7. The system of claim 1, wherein the blanket is partially or completely rolled up and stored inside the headwear for transportation and display purposes.

8. A method of securely storing a blanket inside a headwear, comprising:

providing a blanket;

providing a headwear having an opening, said headwear detachably attachable to the blanket, wherein the headwear having a first securing means;

rolling up the blanket;

inserting the rolled-up blanket into the opening of the headwear; and storing the blanket and headwear together in a coordinated manner, wherein the blanket having four edges, and wherein a first edge of the four edges comprises a lip including thereon a second securing means for removably securing the blanket to the headwear, said lip having a curved border protruding from the first edge and a base bordering the first edge, the length of the base of the lip being less than half the length of the first edge, wherein the headwear is secured in such a fashion as to surround the lip of the first edge of the blanket.

9. The method of claim 8, further comprises displaying the rolled up blanket within the headwear as a headwear and blanket system on a retail display shelf for aesthetically appealing to a consumer.

10. The method of claim 9, wherein the displaying step comprises displaying multiple headwear and blanket systems on at least two retail display shelves.

* * * * *